US006234090B1

(12) United States Patent
Wark et al.

(10) Patent No.: US 6,234,090 B1
(45) **Date of Patent: *May 22, 2001**

(54) LINEAR DIFFUSER FOR BALANCING COAL FLOW

(75) Inventors: Rickey E. Wark, The Woodlands, TX (US); John Anthony Nardi, Clinton Township, MI (US)

(73) Assignee: Sure Alloy Steel Corporation, Madison Heights, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/432,931

(22) Filed: Nov. 3, 1999

Related U.S. Application Data

(63) Continuation-in-part of application No. 09/386,751, filed on Aug. 31, 1999.

(51) Int. Cl.[7] ..... F23K 3/02

(52) U.S. Cl. ..... 110/104 R; 110/104 A; 110/218

(58) Field of Search ..... 110/104 A, 104 R, 110/218, 219, 220, 104; 241/52, 101.7; 251/127

(56) References Cited

U.S. PATENT DOCUMENTS

| | | | | |
|---|---|---|---|---|
| 167,636 | * | 9/1875 | Bogen | 251/127 |
| 391,873 | | 10/1888 | Allington . | |
| 1,120,534 | | 12/1914 | Pruden . | |
| 1,315,719 | | 9/1919 | Grindle . | |
| 1,318,375 | | 10/1919 | Goff . | |
| 1,747,522 | * | 2/1930 | Marchand | 110/104 R |
| 2,083,126 | * | 6/1937 | Shuman | 110/104 |
| 2,184,297 | | 12/1939 | Grindle . | |
| 2,510,240 | | 6/1950 | Mayo . | |
| 3,887,141 | * | 6/1975 | Francis | 241/52 |
| 3,915,395 | * | 10/1975 | Graf | 241/101.7 |
| 4,256,044 | | 3/1981 | Burton . | |
| 5,463,967 | | 11/1995 | Gielow et al. . | |
| 5,605,103 | * | 2/1997 | Larue | 110/262 |
| 5,645,381 | | 7/1997 | Guidetti et al. . | |
| 6,055,914 | | 5/2000 | Wark . | |

FOREIGN PATENT DOCUMENTS

| | | |
|---|---|---|
| 247350 | 10/1963 | (AU) . |
| 63-259316 | 10/1988 | (JP) . |

* cited by examiner

*Primary Examiner*—Denise L. Ferensic
*Assistant Examiner*—Kenneth B. Rinehart
(74) *Attorney, Agent, or Firm*—Young & Basile, P.C.

(57) ABSTRACT

In a delivery pipe for pulverized coal fines from a coal mill to a combustion chamber, a device for diffusing unevenly distributed coal flow evenly across the pipe. In a first form, the invention comprises a plurality of static, lateral, linear diffuser elements comprising rows of protrusions or teeth spaced laterally across the coal flow path in the pipe, preferably in a staggered and overlapping relationship. In a second form, the diffuser elements are rotatably mounted across the coal flow path in the pipe, and may be rotated at different speeds and in different directions. The diffuser elements spaced across the coal flow path in the pipe may be supplemented by peripherally-mounted diffuser elements at the inlet of that portion of the pipe or housing to provide an angled pre-diffusion of the coal flow from the sides of the pipe toward the lateral elements extending across the interior of the pipe.

7 Claims, 5 Drawing Sheets

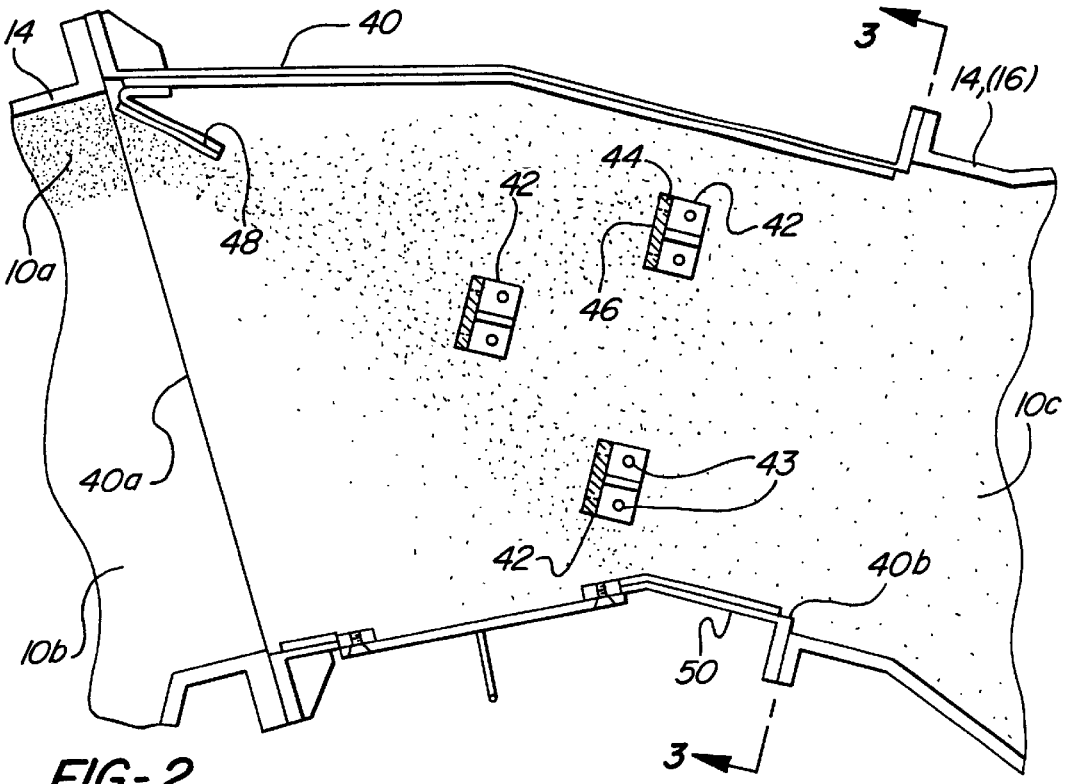
FIG-2
FIG-3
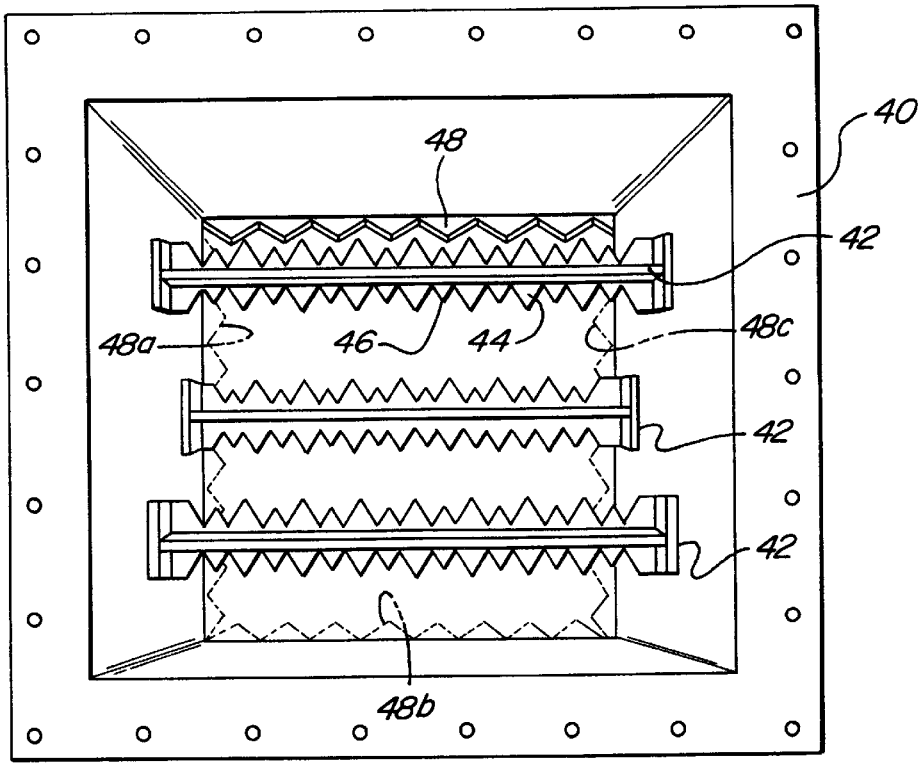

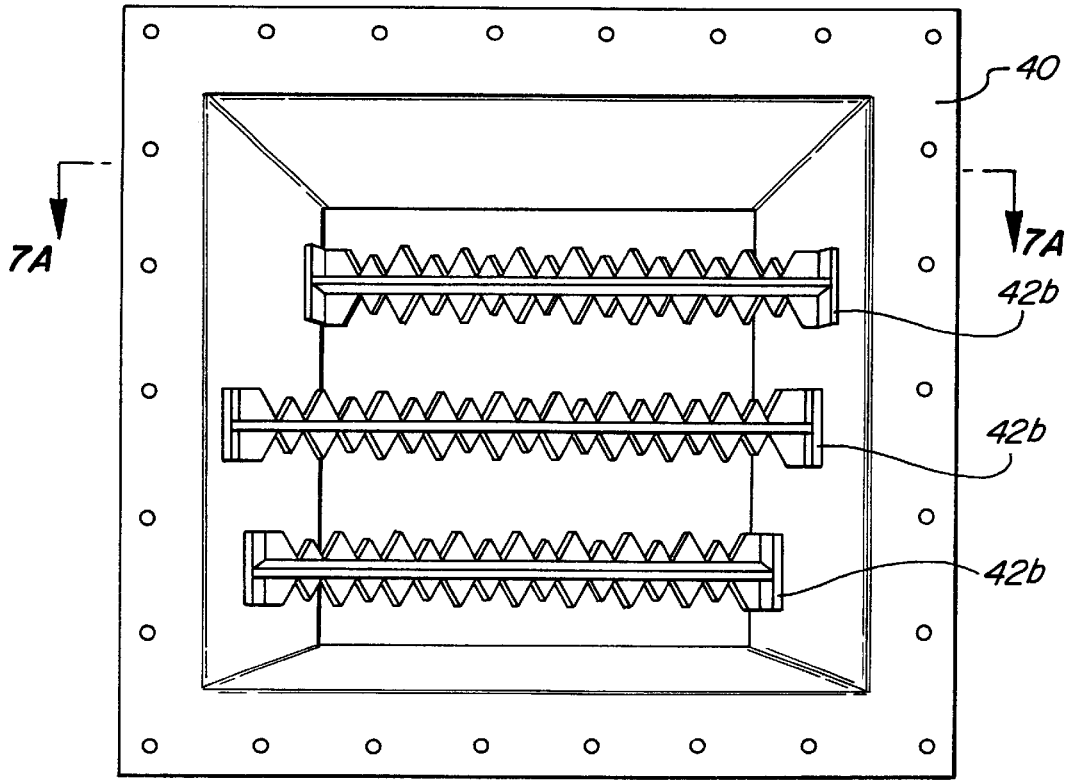
FIG-7
FIG-7A
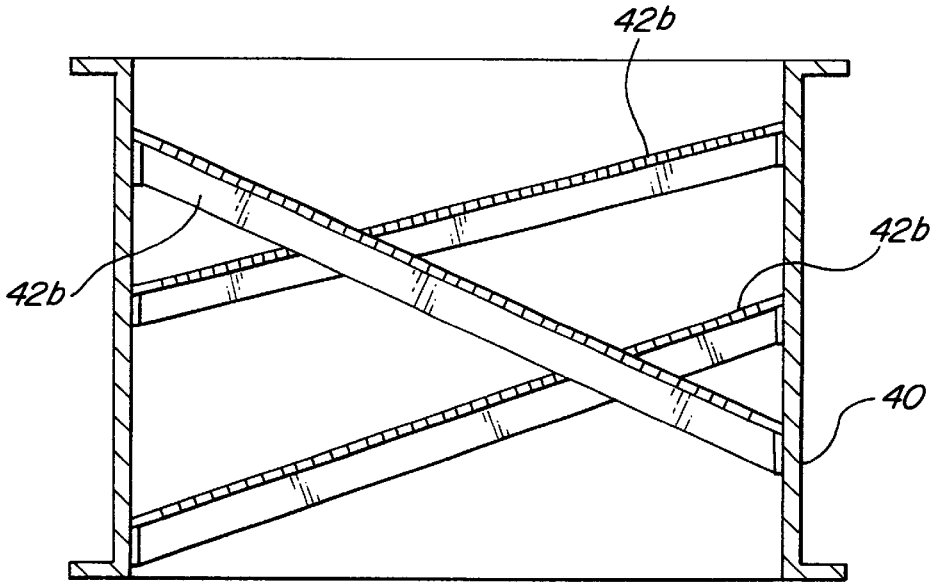

LINEAR DIFFUSER FOR BALANCING COAL FLOW

RELATED APPLICATIONS

This application is a continuation-in-part of co-pending U.S. application Ser. No. 09/386,751 filed Aug. 31, 1999.

FIELD OF THE INVENTION

The present invention is in the field of equipment for producing evenly distributed flows of dust-like coal fines from a coal mill to a power-plant type combustion chamber through one or more delivery pipes.

BACKGROUND OF THE INVENTION

Coal-fired combustion chambers of the type used in power-generating plants burn dust-like coal fines which are ground or pulverized by an on-site coal mill. It is critical to deliver even, distributed flows of coal fines to the multiple burners in the combustion chamber to prevent "rich" areas in the combustion chamber which produce LOI (loss on ignition) particles; "lean" areas which promote NOX formation; elliptical fireballs, which create uneven heating and fireball impingement on the boiler tube "water walls"; coal falling out of suspension in the delivery pipes, causing spontaneous combustion fires and risk of explosion; and, fireball backup in "light flow" burners, which can seriously damage them.

One prior art device which attempts to provide evenly distributed flows of coal among multiple pipe branches on the way to the burners is the "riffle box", typically a series of alternately-angled plates or bars placed at each branching of the pipes in an attempt to redistribute the heavy and light coal flows or "ropes" which often develop across the delivery pipe. Schematic examples of riffles boxes are shown in FIG. 1.

Riffle boxes have generally been found to be unsuccessful in creating evenly distributed flows of coal in the downstream pipe branches. A significant improvement over riffle box type devices is found in co-pending U.S. application Ser. No. 08/987,646, co-owned with the present application. That application discloses a device which causes heavy and light flows of coal distributed across a pipe to converge upon one another, preferably upstream of the riffle box, causing them to implode and be evenly distributed across the width of the pipe. This device has been found to be particularly useful for round, large-diameter delivery pipes. It is, however, somewhat difficult to fit to rectangular conduits because it requires upstream and downstream rectangular-to-round adapters.

SUMMARY OF THE INVENTION

The present invention is a device for diffusing coal flow into an even distribution across a delivery pipe, resulting in even flow through all downstream pipes and burners, generally comprising a plurality of toothed, linear diffuser elements mounted laterally across the width of a delivery pipe. The invention can be used in both round and rectangular pipes, but is considered to be particularly useful for rectangular-conduit pipe.

There are two basic embodiments of the invention: a set of linear static diffuser elements comprising fixed, toothed, laterally-placed elements mounted across the width and/or about the periphery of the delivery pipe; and, one or more linear, rotating diffuser elements placed laterally across the delivery pipe and rotatingly adjustable (either by hand to a fixed position or continuously rotating by motor).

The linear diffuser elements can be built directly into a section of existing delivery pipe or, in a preferred form, are built into a housing which mimics the cross section of the delivery pipe and can be placed in line with the pipe, either between two sections or by cutting out part of the existing pipe and inserting the housing.

The "teeth" of the diffuser elements may be pointed, square, or round, but are preferably of alternating height across the length of the diffuser element to break the segregated coal flow into a diffused, evenly distributed (random) pattern. In general larger "teeth" or protrusions are used for denser, heavier regions of flow within the conduit.

These and other advantages and features of the invention will become apparent upon further reading of the specification, in light of the accompanying drawings.

BRIEF DESCRIPTION OF THE DRAWINGS

FIG. 2 is an elevational side view, partially in section, of a first embodiment of the invention in which linear static diffuser elements are placed across the path of coal flow in the delivery pipe;

FIG. 3 is a front elevational view of the linear diffuser elements of FIG. 2, illustrated as being mounted in a rectangular housing laterally across the flow area of the housing (shown in solid lines), and in an optional or alternate set of peripheral diffuser elements located around the periphery of the entrance of the housing (shown in broken lines);

FIG. 7 is a front elevational view of yet another alternate arrangement of the linear diffuser elements, in which the linear diffuser elements are placed in an upstream/downstream angled pattern within the housing; and, FIG. 7A is a plan view of FIG. 7.

DETAILED DESCRIPTION OF THE ILLUSTRATED EMBODIMENTS

Figure 1:
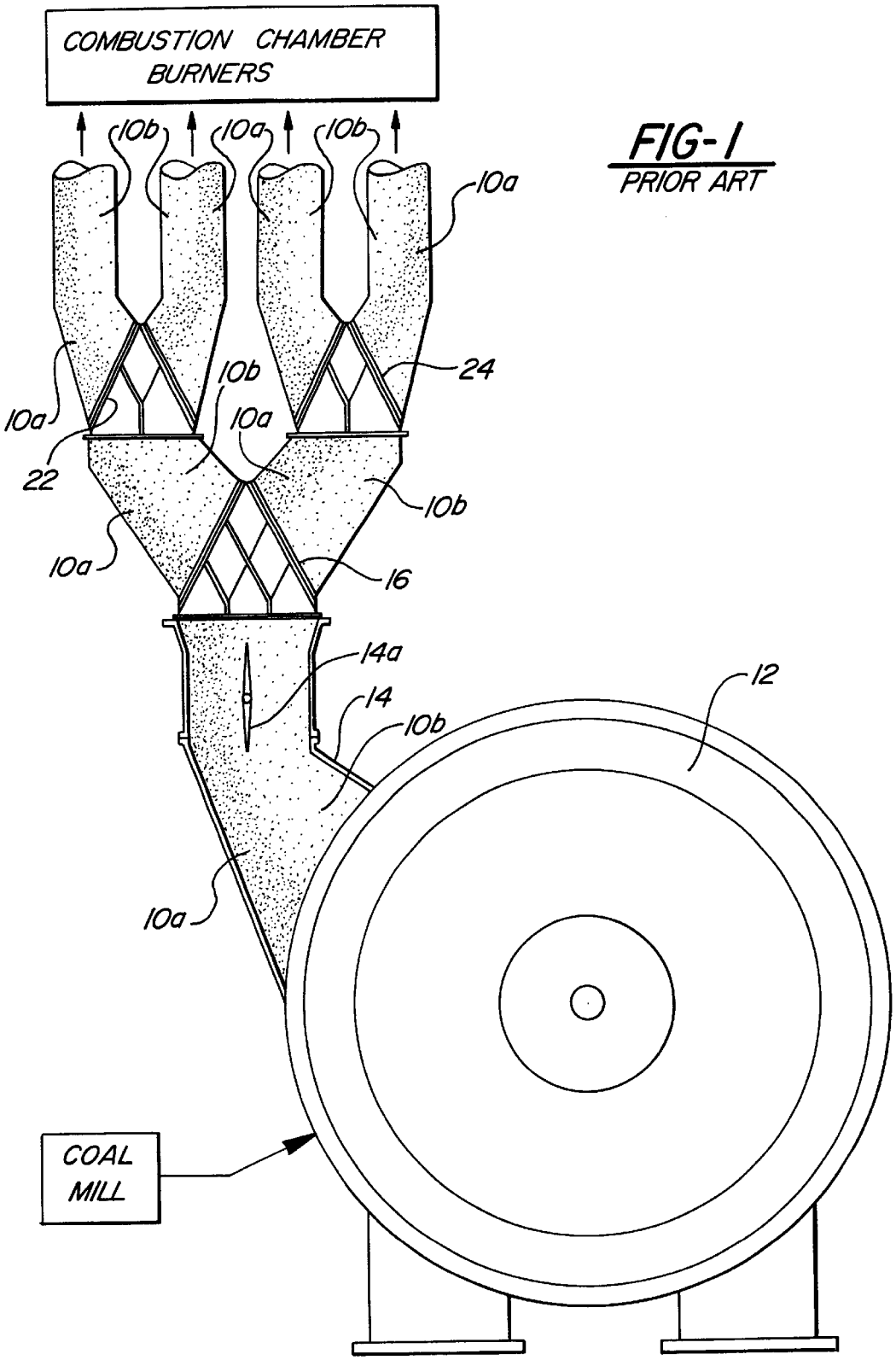
FIG-1 PRIOR ART
FIG. 1 schematically illustrates the prior art exhauster fan and branched delivery pipe arrangement, in which each branch of the delivery pipe is provided with a riffle box in an attempt to redistribute uneven flows of coal through the pipes.

Referring first to FIG. 1, a prior art exhauster fan type delivery system using prior art riffle boxes for even coal distribution is illustrated in schematic, foreshortened form. It will be understood by those skilled in the art that although an exhauster fan type delivery system using riffle boxes is used for purposes of illustration, the present invention will also be useful in coal fine delivery systems using delivery means other than exhauster fans, in delivery systems with or without riffle boxes, and with different numbers and branch arrangements of pipes.

Exhauster fan 12 is illustrated schematically, and may be any of a number of commercially available types known to those skilled in the art. The exhauster fan sucks coal from a coal mill (not shown) and delivers it to a main outlet/delivery pipe 14 which may or may not be provided with some sort of baffle 14*a* for steering or angling the coal flow to one side or the other of the pipe. Baffle 14*a* is often used in conjunction with one or more riffle boxes 16, 22, 24 of known type, whose purpose is ostensibly to redistribute uneven coal flow evenly across the downstream pipes' diameters, but which in reality is found to be generally unsatisfactory for this purpose.

The coal flow 10*a*, 10*b* is illustrated in the typically uneven distribution which occurs as the coal leaves the exhauster fan and the heavier particles settle into a rich distribution 10*a* on one side of the pipe while the lighter particles segregate into a lighter distribution 10*b* on the other side of the pipe.

It can be seen from FIG. 1 that the riffles boxes do not effectively eliminate the original uneven distribution 10*a*, 10*b* created by the segregation of heavier and lighter particles leaving the exhauster. The present invention solves this problem.

Referring now to FIGS. 2 and 3, a first "static" embodiment of the present invention is illustrated in a main section of the delivery pipe roughly corresponding to the location of baffle 14*a* shown in FIG. 1. In the illustrated embodiment the invention is illustrated as being contained in a self-contained housing adapter 40 generally matching the configuration of the delivery pipe 14. In the illustrated embodiment, the housing is illustrated as matching a square conduit, although it would be possible to use the invention in round conduits and other shapes.

FIGS. 2 and 3 illustrate a plurality of lateral diffuser elements mounted across the width of housing 40 in the path of coal flow, preferably in a staggered upstream/downstream arrangement generally as illustrated. Diffuser elements 42 comprise lateral, double-edged rows of "teeth" or similar projections 44, 46 in alternating high/low arrangements. In the illustrated embodiment high teeth 44 and low teeth 46 are staggered in alternating, symmetrical arrangements across the diffuser elements, although it may be possible to use rows of teeth of even height or asymmetrical patterns of high/low teeth, depending on the characteristics of the coal flow into the diffuser elements and the nature of the redistribution desired. It is believed, however, that the alternating high/low teeth produce an optimal diffusion pattern.

As stated above, it will be apparent to those skilled in the art that the triangular pointed types of teeth shown, although preferred, can be replaced with teeth or projections formed with rounded or squared ends.

Housing 40 may be bolted, welded or otherwise secured at its inlet and outlet ends 40*a*, 40*b* to standard sections of delivery pipe. It will also be understood that diffuser elements 42 could be retrofitted into an integral section of delivery pipe, if desired.

In another aspect of the invention, a peripheral diffuser element 48, similar in construction to elements 42 but single-edged and with symmetrical teeth, is located at the periphery of the housing inlet 40*a*, in the illustrated embodiment located along the side of the housing where heavy distribution of coal 10*a* is anticipated. This inlet-mounted peripheral element 48 provides a pre-diffusion for elements 42, ensuring that the heavy distribution of coal flow impinges all three elements 42 for optimal diffusion. To achieve this, peripheral diffuser element 48 is preferably angled inwardly relative to the center of the housing, generally at the leading element 42, for optimal diffusion as shown.

The coal flow from the inlet of housing 40*a*, whether or not pre-diffused by element 48, impinges lateral fixed elements 42 and is diffused across the area of the housing and delivery pipe to achieve a substantially uniform diffusion or distribution of coal 10*c* at the outlet end of the housing.

In an alternate form of the invention of FIGS. 2 and 3, peripheral diffuser elements 48*a*, 48*b*, and 48*c* can be provided on the remaining three sides of the housing inlet to provide full coverage around the periphery of the housing inlet. It will also be understood that the three lateral elements 42 could be used without any peripheral elements 48, or that peripheral elements 48 could be used by themselves without lateral elements 42, again depending on the coal distribution problem found in the pipe and the desired diffusion effect.

It will also be understood that lateral elements 42 can be placed virtually anywhere in the delivery pipe system between the delivery source (e.g., exhauster 12 as shown in FIG. 1) and the combustion chamber, although the optimal placement is believed to be upstream of the primary riffle elements 16 as shown in FIG. 1.

It will also be apparent from the drawings that although elements 42 are illustrated as being bolted to the sides of housing 40 by bolts 43 on suitably formed ends of the elements, they may be fastened in place in virtually any known manner. It is preferred, however, to make them removable for occasional replacement or even adjustment in the flow path of the coal, for example through built-in access/maintenance hatch 50. It will also be understood by those skilled in the art that while the illustrated embodiments are shown as based on flat bars of abrasion-resistant metal, other shapes may be useful.

Figure 4:
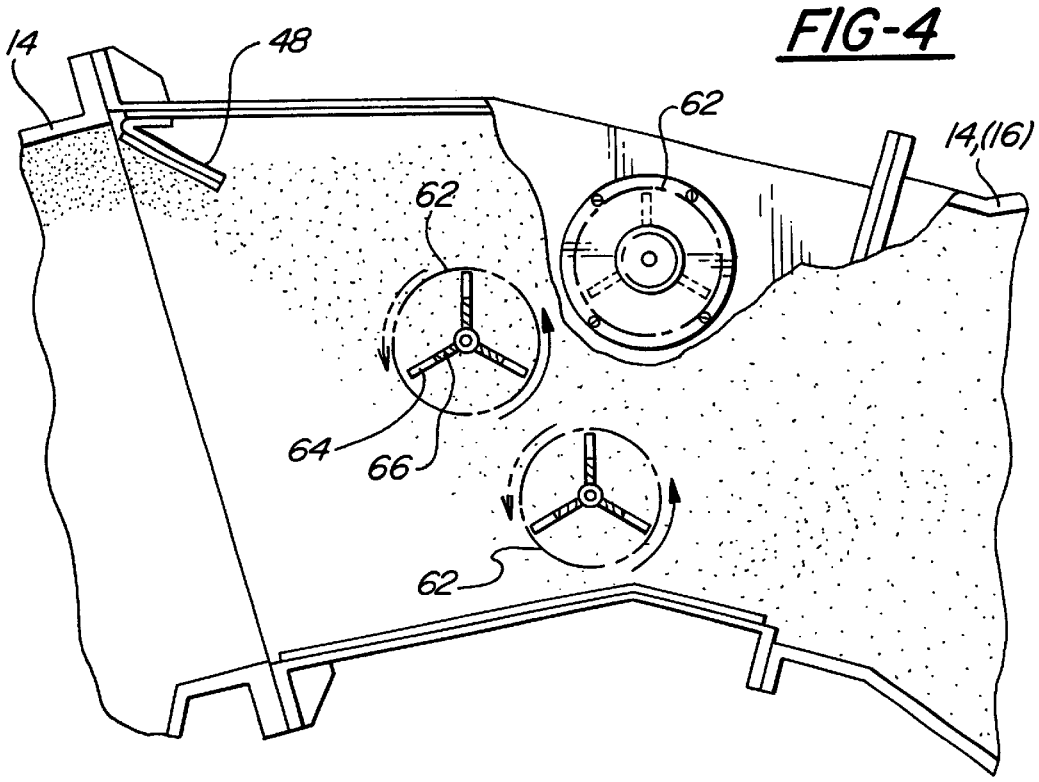
FIG. 4 is an elevational side view, partially in section, of a plurality of linear dynamic (rotatable) diffuser elements according to the invention, showing a motorized embodiment; and, FIG. 5 is a front elevational view of two of the dynamic diffuser elements of FIG. 4, with one shown partially removed from its housing.
Figure 5:
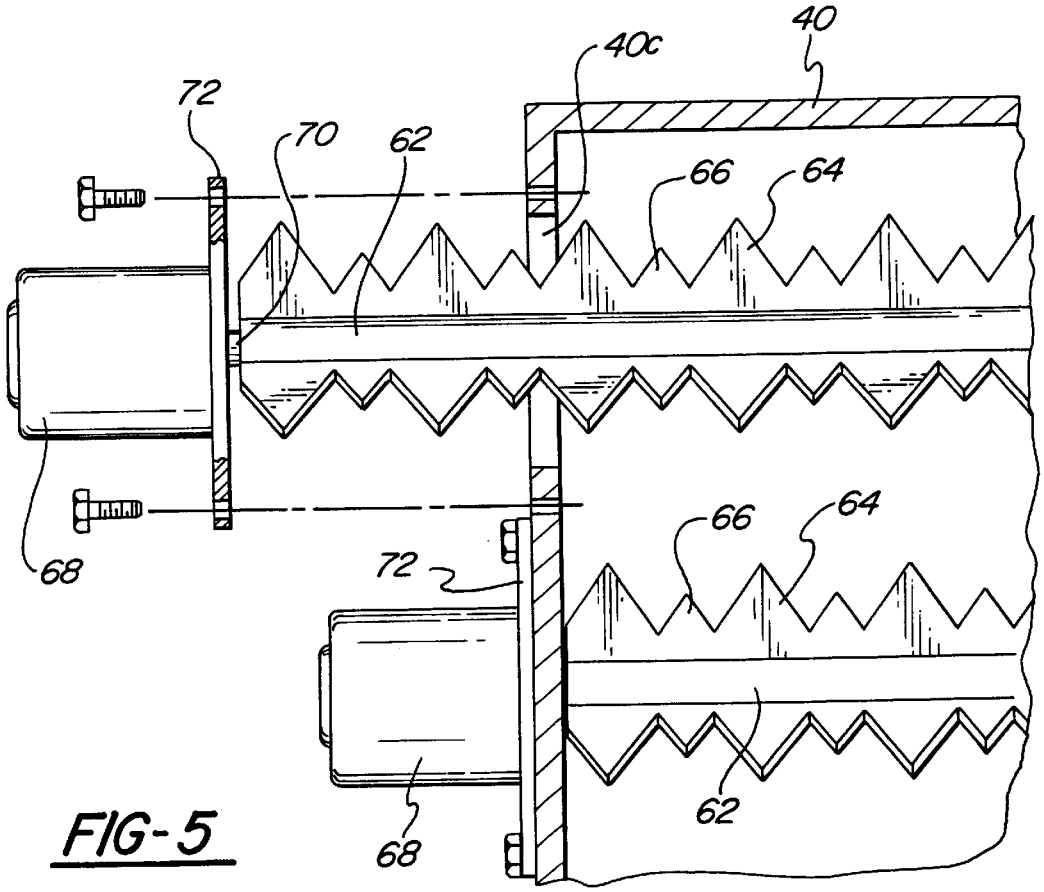

Referring next to FIGS. 4 and 5, a second embodiment of the invention is illustrated comprising a plurality of "dynamic" diffuser elements 62 mounted in housing 40 in a manner similar to lateral fixed elements 42 shown in FIGS. 2 and 3, i.e. in a staggered, lateral arrangement with essentially overlapping coverage of the coal flow path through housing 40. The main difference between dynamic elements 62 and static elements 42 is that dynamic elements 62 are rotatably adjustable in housing 40, either by hand or by motor. In a most basic form, the multi-sided dynamic elements 62 could be rotatably adjusted between fixed diffusing positions. It is preferred; however, that elements 62 be continuously rotatable for the diffusion process.

In the illustrated embodiment, dynamic elements 62 comprise three-sided rows of teeth 64, 66 similar to teeth 44, 46 in FIGS. 2 and 3.

In the preferred form, dynamic elements 62 are rotated by motors 68 attached to elements 62 through a rotatable shaft 70 keyed or otherwise secured to elements 62 to cause them to rotate therewith. Motors 68 and elements 62 preferably each comprise an individual rotating unit, which can be removed as a unit from the housing as best shown in FIG. 5 by unbolting a mounting flange 72 and pulling the element through opening 40*c* through which the element is inserted and mounted in the housing. It will be understood, however, that the shafts could be driven by a common motor through suitable gearing and shaft arrangements of a type that will be apparent to those skilled in the art. They may also be rotated by hand, although the motorized version is much preferred.

The dynamic elements 62 provide an enhanced diffusion action in the housing, as their dynamic, rotating action coupled with the lateral arrays of diffusion teeth ensures a rapid and widespread diffusion across housing 40. The diffusion effect can be enhanced by rotating individual elements 62 at different speeds relative to one another, or even by rotating them in different directions. For such embodiments reversible motors are preferred.

It will be apparent to those skilled in the art that while rotary dynamic diffusion elements 62 are shown as three-edged, the number of edges or rows of diffusion projections or teeth can vary, for example two, four, etc.

And, while the staggered, overlapped arrangement of elements 62 as illustrated is preferred, their rotating nature, and the option of adjusting both their speed and direction of rotation, allows for more latitude in their spacing and positioning in the housing to achieve full diffusion. The staggered upstream/downstream arrangement, however, is important to prevent the impedance and pressurization of flow in the conduit.

Like the static elements 42 in the embodiment of FIGS. 2 and 3, the dynamic rotating elements 62 in FIGS. 4 and 5 can be retrofitted into existing delivery pipe of virtually any configuration, or can be provided as a multi-element adapter housing 40 fitted between sections of pipe 14. As shown in FIGS. 4 and 5, elements 62 can also be used in conjunction with static peripheral elements such as 48 providing a peripheral, "kicker" effect at the housing inlet.

In the embodiment of FIGS. 2 and 3, the lateral diffuser elements 42 are arranged along an axis across housing 40 in a direction that will arbitrarily be called "horizontal" given the orientation of the drawings. It will be understood that by "lateral" we do not intend to limit the invention to a single axial orientation of the diffuser elements in the housing such as the "horizontal" arrangement shown. Rather, other axial arrangements of the diffuser elements 42 laterally across the housing in place of or in supplement to the illustrated "horizontal" arrangement are possible. For example, referring to FIGS. 6 and 6A, additional diffuser elements 42*a* are arranged laterally across the housing in a direction which is "vertical" relative to the "horizontal" arrangement of elements 42. And while a 90° rotational offset between elements 42 and 42*a* is illustrated for the rectangular housing, it will be understood that housings of different cross-sectional geometry will allow for different rotational offsets between dffuser elements.

Figure 6:
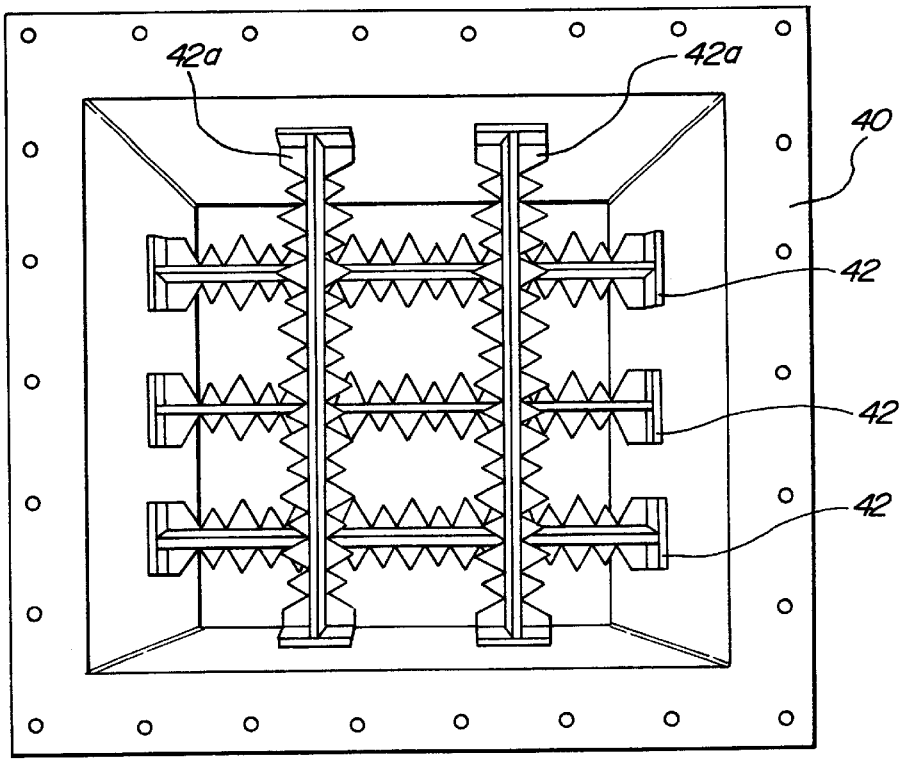
FIG. 6 is a front elevational view of an alternate arrangement of linear diffuser elements, in which the horizontal diffuser elements of FIG. 2 are supplemented by vertical linear diffuser elements.
Figure 6A:
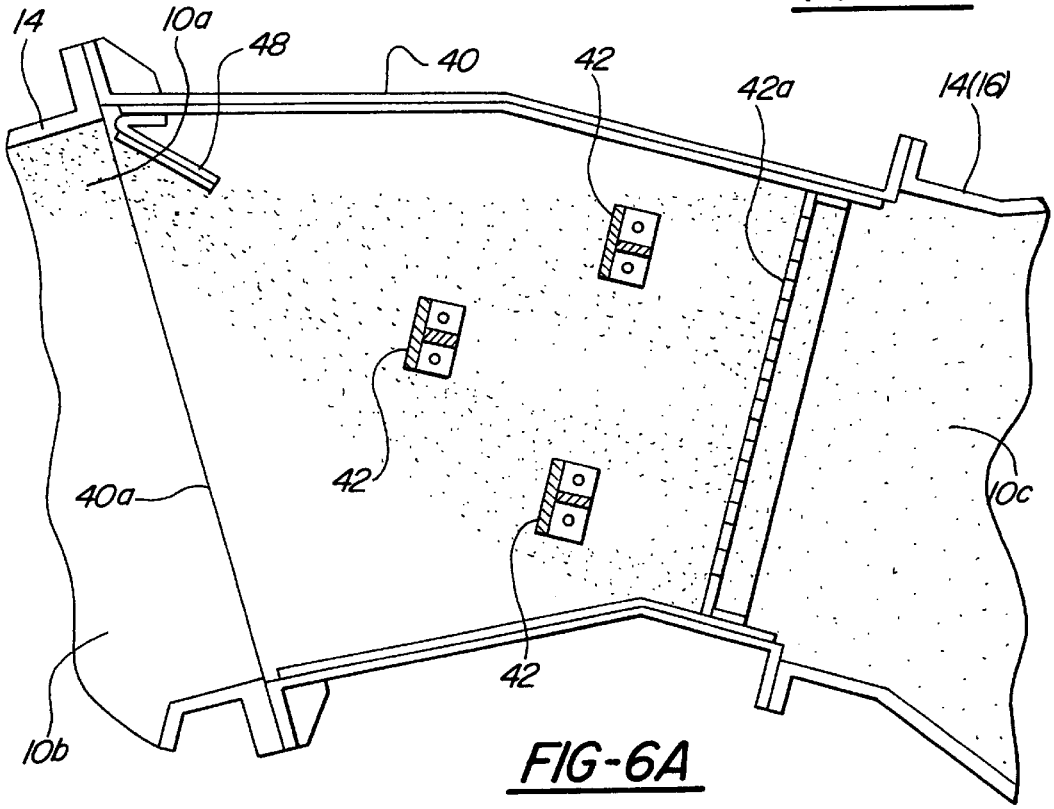
FIG. 6A is a side view of FIG. 6.

It will also be understood that the lateral diffuser elements can be placed at angles other than right angles to the flow through the pipe. As shown in FIGS. 7 and 7A, angled placement of diffuser elements such as 42*b* in housing 40 can be implemented, for example, with staggered upstream/downstream angles of 45° relative to the flow through the housing. While the diffuser elements will "look" substantially perpendicular from the head-on direction of flow into the housing (FIG. 7), the overall length of the diffuser elements is increased for greater diffuser surface area (FIG. 7A), and the angled arrangement may provide an improved diffusion in some cases. It will be further understood that this angled placement of the linear diffuser elements can be applied to both "horizontally" arranged and "vertically" arranged diffuser elements as shown in FIGS. 6 and 6A.

It will be understood from the foregoing that the embodiments illustrated herein are preferred embodiments presented for purposes of explanation, and are not intended to limit the invention beyond the scope of the appended claims. It will be apparent to those skilled in the art that both the static and dynamic diffuser elements can take different geometrical forms and shapes, and can be located in different arrangements and in varying combinations in the pipe or adapter housing without departing from the invention.

Accordingly, we claim:

1. In a delivery pipe flow path of pulverized coal fines from a coal mill to a coal-fired combustion chamber, a diffusing device comprising:

a plurality of diffuser elements placed laterally in the delivery pipe in the path of coal flow through the pipe to intersect at least a heavy distribution portion of the coal flow and to diffuse the coal flow evenly in the delivery pipe, the diffuser elements each comprising an array of radial teeth extending radially from each diffuser element, wherein the diffuser elements are oriented in the delivery pipe at acute angles relative to the path of coal flow through the pipe.

2. The apparatus of claim 1, wherein the diffuser elements each comprise an element fixed in place in the delivery pipe.

3. The apparatus of claim 1, wherein the acutely-angled diffuser elements are arranged in a staggered upstream/downstream angled arrangement.

4. In a delivery pipe flow path of pulverized coal fines from a coal mill to a coal-fired combustion chamber, a diffusing device comprising:

a plurality of diffuser elements placed laterally in the delivery pipe in the path of coal flow through the pipe to intersect at least a heavy distribution portion of the coal flow and to diffuse the coal flow evenly in the delivery pipe, the diffuser elements each comprising an array of radial teeth extending radially from each diffuser element, wherein a first diffuser element and a second diffuser element are rotationally offset relative to one another.

5. The apparatus of claim 4, wherein the first diffuser element is substantially horizontal and the second diffuser element is substantially vertical.

6. The apparatus of claim 4, wherein the first and second diffuser elements are oriented in the delivery pipe at acute angles relative to the path of coal flow through the pipe.

7. In a delivery pipe flow path of pulverized coal fines from a coal mill to a coal-fired combustion chamber, a diffusing device comprising:

a diffuser element placed laterally in the delivery pipe in the path of coal flow through the pipe to intersect a portion of the coal flow and to diffuse the coal flow evenly in the delivery pipe, the diffuser element comprising a linear array of radial teeth.

* * * * *